US006353934B1

(12) United States Patent
Tada et al.

(10) Patent No.: US 6,353,934 B1
(45) Date of Patent: Mar. 12, 2002

(54) OUTERWEAR

(75) Inventors: Yoshio Tada, Hyogo; Akio Sugi; Satomi Fujita, both of Osaka-fu, all of (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/464,773

(22) Filed: Dec. 16, 1999

(30) Foreign Application Priority Data

Dec. 28, 1998 (JP) ..... 10-373828
Oct. 28, 1999 (JP) ..... 11-307243

(51) Int. Cl.[7] ..... A41D 1/02; A41D 1/18; A41D 3/04

(52) U.S. Cl. ..... 2/115; 2/125; 2/106; 2/108; 2/87

(58) Field of Search ..... 2/115, 125, 105, 2/106, 108, 90, 243.1, 69, 77, 78.1, 78.3, 82, 85, 87, 93, 113, 118, 122

(56) References Cited

U.S. PATENT DOCUMENTS 1,260,353 A * 3/1918 Evleth ..... 2/90
2,369,416 A * 2/1945 Solomon ..... 2/115
2,426,819 A * 9/1947 Clyne ..... 2/93
2,613,360 A * 10/1952 Friedland et al. ..... 2/90
2,725,566 A * 12/1955 Vogler et al. ..... 2/74
2,839,756 A * 6/1958 Geiss ..... 2/125
D192,136 S * 1/1962 Tiso et al. ..... D3/4
3,037,210 A * 6/1962 Neuman ..... 2/90
3,078,699 A * 2/1963 Huntley ..... 66/176
4,513,451 A * 4/1985 Brown ..... 2/108
4,802,282 A 2/1989 Fujimura et al. ..... 33/12
4,939,844 A 7/1990 Fujimura et al. ..... 33/12
5,608,913 A * 3/1997 Lacoste ..... 2/108

* cited by examiner

*Primary Examiner*—Amy B. Vanatta
(74) *Attorney, Agent, or Firm*—Armstrong, Westerman & Hattori, LLP

(57) ABSTRACT

A outerwear comprising of a front body cloth, a rear body cloth, right and left flank cloths having a predetermined width and right and left sleeve cloths, one edge of each right and left flank cloth is sewn to the front body cloth and the other edge of each right and left flank cloth is sewn to the rear body cloth such that each sewing line does not coincide with right and left flank lines, each of the right and left flank cloth is extended to the under-sleeve part sewn to the sleeve cloth; an elongation percentage of each of the front body cloth and the rear body cloth is set high in a horizontal direction thereof.

5 Claims, 18 Drawing Sheets

OUTERWEAR

BACKGROUND OF THE INVENTION

1. Field of the Invention

The present invention relates to outerwear such as a polo shirt, a windbreaker, and rainwear. More particularly, the present invention relates to [an] outerwear suitable for playing golf, tennis, and other sports that stretch so as to follow a player's actions of twisting the body and swinging the arms widely.

2. Description of the Related Art

In a golf course, a golfer usually wears a polo shirt with a half-length sleeve in summer, a polo shirt with a long sleeve in spring and autumn, and a sweater over the polo shirt in winter. When it is windy and cold, some persons wear the windbreaker over the polo shirt or the sweater. When it is rainy, some persons wear the rainwear over the polo shirt or the sweater. As shown in FIGS. 15A and 15B, the basic outerwear, namely, the polo shirt with the half-length sleeve and the long sleeve are formed by sewing a front body cloth 1 and a rear body cloth 2 to each other at flank lines L1 and L2; sewing a sleeve 3 to the front body cloth 1 and the rear body cloth 2 along the armhole of each thereof; forming opening 1*a* each having a required diameter at upper center positions of the front body cloth 1 closed by buttons; and sewing a neck cloth 5 to the front body cloth 1 and the rear body cloth 2 round its neck. Needless to say, a golfer puts on the polo shirt by slipping it over the user's head. The edge of the sleeve is of open type or closed type. The edge of the sleeve of the closed type has a rib stitch portion sewed thereto.

To allow the polo shirt for a golfer to follow the golfer's action of swinging a golf club, the polo shirt is made of cloth of which thread of 100% cotton or mixed thread of cotton and polyester are knitted so as to be stretchable. However, the polo shirt made of the cloth is stretchable uniformly as a whole. That is, the method allowing a specific part of the polo shirt is not stretchable in a specific direction.

Further, the conventional polo shirt made of the stretchable cloth has the following problem: That is, as described above, the front body cloth 1 and the rear body cloth 2 are sewed to each other along flank lines L1 and L2. That is, each sewing line is coincident with each of the flank lines L1 and L2. As the part along each sewing line is stretchable in a low degree, the part along each of the flank lines L1 and L2 is less stretchable than other parts thereof in the polo shirt. The sleeve 3 is sewed to the front body cloth 1 and the rear body cloth 2 along the armhole of each thereof. Thus, in the polo shirt, the part along the armhole is also less stretchable than other parts thereof.

Because the golfer twists the body and swings the arms, the golfer makes a stretching action along the flank lines L1 and L2 and a shoulder-turning action in a wide range. Thus, the polo shirt is required to stretch along the flank lines L1 and L2 and in particular, vertically in a great amount. However, as described above, each of the sewing lines along which the front body cloth 1 and the rear body cloth 2 are sewed to each other is coincident with each of the flank lines L1 and L2. Therefore, the part along each of the flank lines L1 and L2 stretches vertically in a smaller amount than other parts of the polo shirt. Similarly, because the golfer swings the arms widely, the polo shirt is required to stretch horizontally in a great amount around the shoulder. However, as described above, the sleeve 3 is sewed to the front body cloth 1 and the rear body cloth 2 along the armhole of each thereof. Thus, the sewing line along which the sleeve 3 is sewed to the front body cloth 1 and the rear body cloth 2 is coincident with the margin of the armhole of each thereof. Therefore, the part along the armhole stretches in a smaller amount than other parts of the polo shirt.

As apparent from the above description, in the conventional polo shirt, the sewing line is present in the portion required to stretch. Thus, the stretch-required portion is stretchable in a low degree when the golfer swings the golf club.

The above-described problem of the conventional polo shirt occurs not only in golf but also in sports such as tennis, badminton, baseball, and the like necessitating players to twist the body and swing the arms. Further, not only in the polo shirt, but also in a T-shirt, the front body cloth and the rear body cloth are sewed to each other along each flank line, and each sleeve is sewed to the front body cloth and the rear body cloth along the armhole of each thereof. The golfer wears the windbreaker when it is windy or cold and the rainwear when it is rainy. Thus, the windbreaker and the rainwear have problems similar to that of the polo shirt, because the front body cloth and the rear body cloth are sewed to each other along the flank line, and the sleeve is sewed to the front body cloth and the rear body cloth along the armhole.

SUMMARY OF THE INVENTION

The present invention has been made in view of the above-described situation. Thus, it is an object of the present invention to provide a sport outerwear such as a polo shirt which is suitable for a golfer in particular and stretchable along a flank line and around a shoulder.

In order to achieve the object, according to the present invention, there is provided a outerwear comprising of a front body cloth, a rear body cloth, right and left flank cloths having a predetermined width and right and left sleeve cloths, said one edge of each right and left flank cloth is sewed to said front body cloth and other edge of each right and left flank cloth is sewed to said rear body cloth such that each sewing line does not coincide with right and left flank lines each of said right and left flank cloth is extended to under-sleeve part sewed to said sleeve cloth; an elongation percentage of each of said front body cloth and said rear body cloth is set high in a horizontal direction thereof.

As described above, in the outerwear of the present invention, both edges of the front body cloth and the rear body cloth are sewed to both edges of each of the right and left flank cloths. That is, each of the sewing lines is not coincident with each of the flank lines. Further, the elongation percentage of each of the right and left flank cloths is set high in the longitudinal direction thereof. Thus, the outerwear can be preferably used as an outerwear for sports such as golf, tennis, and the like. In this case, when a golfer swings up a golf club in a wide range or a tennis player swings up a racket in a wide range, the flank line stretches longitudinally in a great amount. Accordingly, the outerwear does not fit tight in the flank region. That is, the outerwear can preferably follow their swinging actions and the like, thus facilitating and enhancing their actions. The outerwear of the present invention is used not only as a sport outerwear, but also as outerwear for other purposes. For example, because it can preferably follow actions of arms, it can be preferably used as a working outerwear for works necessitating arms to move upward and downward and as everyday clothes.

It is preferable that the rear body cloth is formed so as to extend to a rear part of a sleeve. In the construction, the stretch of the outerwear in the region from the back to the arm thereof is not prevented when the golfer or the tennis player twists the body. This is because no sewing line is present between the rear body cloth and the sleeve. Thus, the outerwear can preferably follow the players' swinging actions and the like. The front body cloth should be formed in much consideration of design. In playing golf or tennis, the golfer and the tennis player swing their arms forward more than backward. Thus, there is no problem if the position of sewing line between the front body cloth and the sleeve is positioned at the armhole. Thus, it is preferable that the front body cloth and the sleeve are sewed to each other at the armhole.

It is preferable that the flank cloth is of Dolman type. In the Dolman type, the sport outerwear is loose at the underarm, which does not make the golfer or the tennis player feel tight and allows them to swing the arms smoothly and in a wide range, and a beautiful silhouette can be formed along the flank line.

It is preferable that the outerwear is formed as a polo shirt having a neck and half-length or long right and left sleeves, and a front body cloth of which is opened and closed in an upper part thereof.

A outerwear may be formed as a windbreaker made of a nonventilative material. The windbreaker may have a V-shaped or U-shaped neck to allow a user to wear it by slipping it over the user's head. Instead, the windbreaker may have an opening part on its front body cloth. A stretchable material is installed on the periphery of opening parts such as the neck, the edge of the sleeve, and the lower end of the body cloth to prevent wind from entering the opening parts. Moreover, the outerwear may be formed as a rainwear made of a waterproof material. The conventional windbreaker and rainwear are not preferable in following behavior of arms. On the other hand, the windbreaker and rainwear of the present invention can follow the behavior of the arms because no sewing lines are formed on the flank part and the armhole.

A long sleeve may be formed of an upper sleeve section positioned above the elbow and consisting of the flank cloth, the rear sleeve part integral with the rear body cloth, and a front upper sleeve cloth sewed to the flank cloth, the front body cloth, and the rear body cloth; and a lower sleeve section consisting of a cylindrical lower sleeve cloth sewed to the upper sleeve section. According to another method of forming a cylindrical long sleeve, the rear body cloth is not integral with the sleeve. In this method, the flank cloth is formed from the lower end of the front body cloth and that of the rear body cloth to the lower open end of the long cylindrical sleeve to be formed; and an upper-side sleeve cloth is sewed to the front body cloth and the rear body cloth along the armhole thereof and to an underside sleeve cloth integral with the flank cloth.

DETAILED DESCRIPTION OF THE PREFERRED EMBODIMENTS

The embodiments of the present invention will be described in detail below with reference to drawings.

Figure 1:
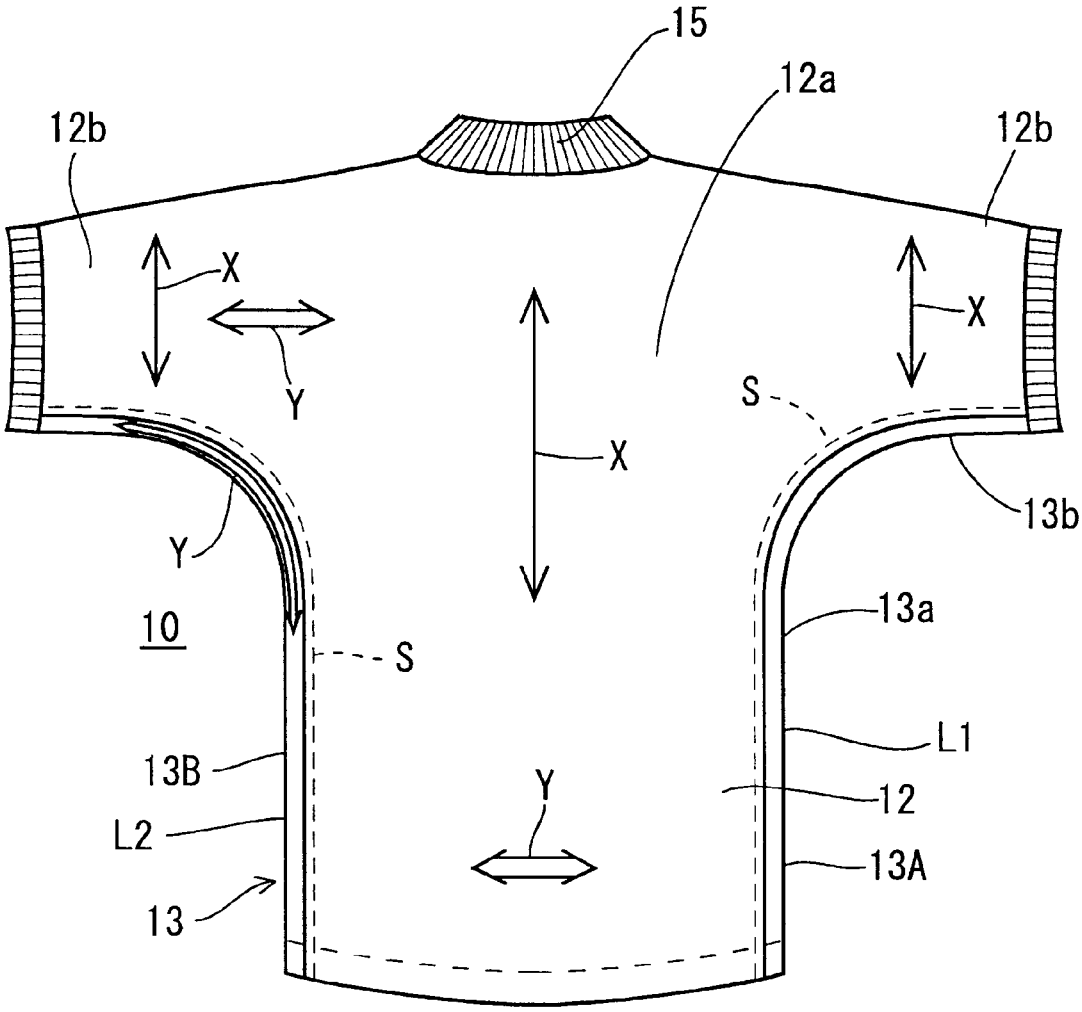
FIG. 1 is a rear view showing a sport outerwear of a first embodiment of the present invention.
Figure 2:
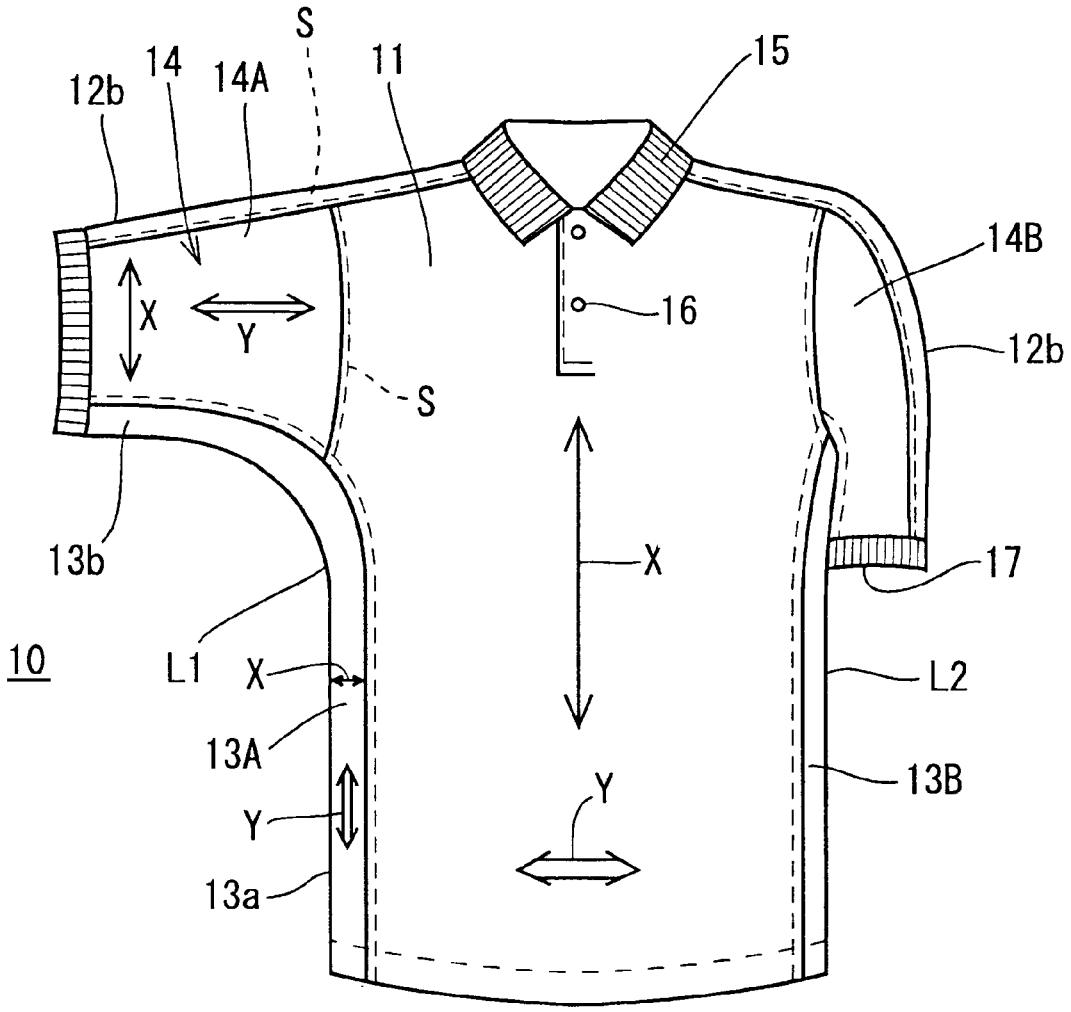
FIG. 2 is a front view showing the sport outerwear shown in FIG. 1.
Figure 3:
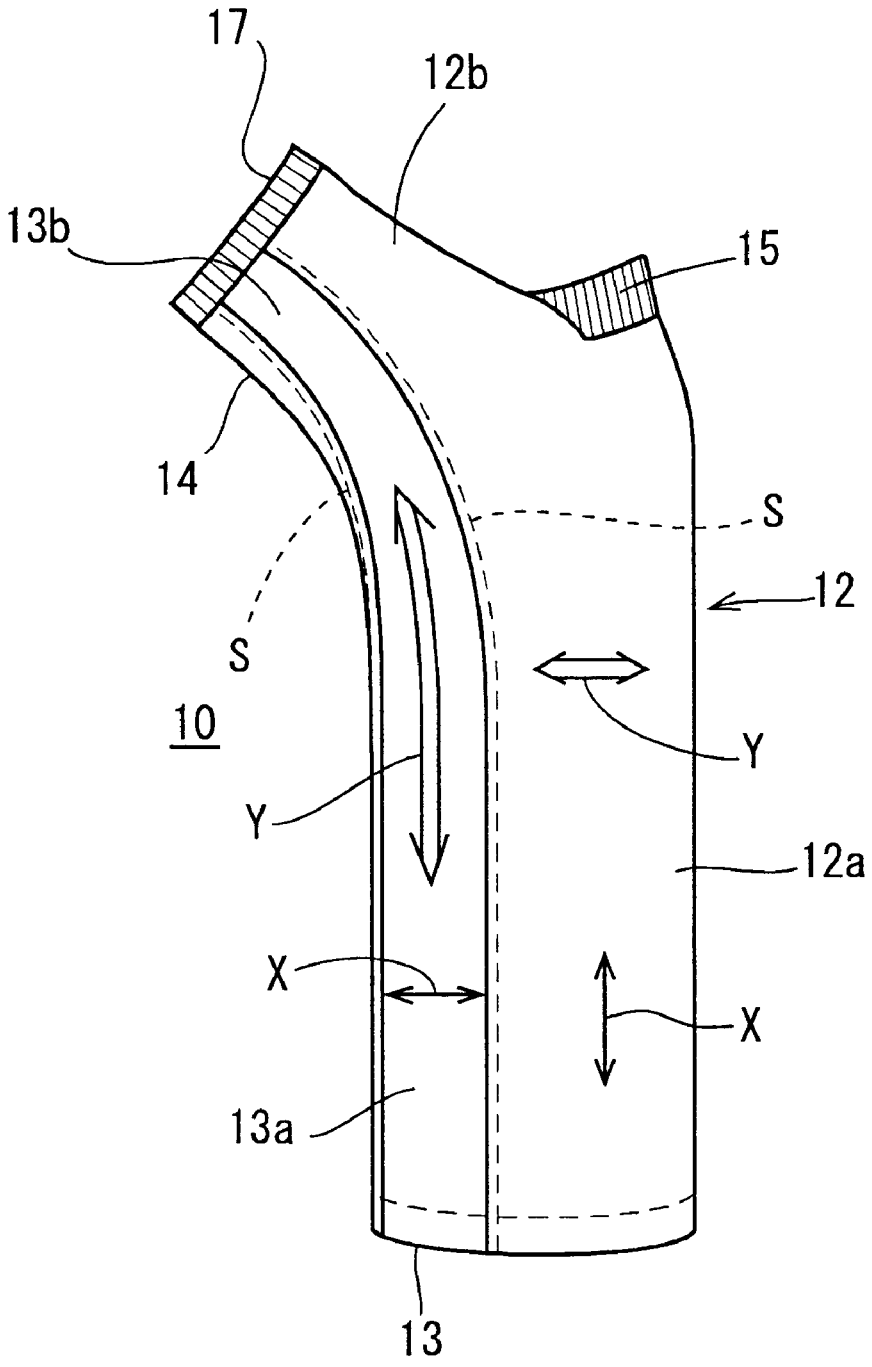
FIG. 3 is a side view showing the sport outerwear of FIG. 1 in the case where a golfer swings the arms upward.

FIGS. 1 through 3 show a polo shirt 10 for a golfer with half-length sleeves according to the first embodiment of the present invention. FIG. 1 shows the back side of the polo shirt 10. FIG. 2 shows the front side thereof. FIG. 3 shows the flank side thereof. As shown in FIGS. 1 through 3, the polo shirt 10 has a front body cloth 11, a rear body cloth 12, right and left flank cloths 13 (13A, 13B), right and left front sleeve cloths 14 (14A, 14B), and a neck cloth 15.

Except the neck cloth 15, the front body cloth 11, the rear body cloth 12, the right and left flank cloths 13 (13A, 13B), and the right and left front sleeve cloths 14 (14A, 14B) are made of 100% cotton thread having a superior water absorption property. The cloth 11–14 are knitted by dapple knitting method to allow stretchable to a high degree. The grain direction of each of these cloths is indicated with arrows X. The direction indicated with a thick arrow Y is perpendicular to the grain direction X. Accordingly, the elongation percentage of each cloth in the direction Y is higher than that in the grain direction X. The knitting method is not limited to the dapple knitting method. For example, it is possible to use plain knitting method (plain stitch knitting method) which allows the cloths to be highly stretchable. But it is necessary to knit the cloths in such a manner that the elongation percentage thereof in the direction Y is higher than the elongation percentage thereof in the grain direction X. The kind of thread to be knitted into the cloths is not limited to the 100% cotton thread but polyester or mixed thread of cotton and polyester may be used.

The one-piece rear body cloth 12 includes a part 12*a* corresponding to the entire back of the polo shirt 10 and a rear sleeve part 12*b*. The right and left edges of the part 12*a* are spaced at a predetermined interval from right and left flank lines L1 and L2, respectively. The stretch direction of the rear body cloth 12 indicated with the thick arrow Y is a horizontal (right-to-left) direction. The elongation percentage of the rear body cloth 12 in the horizontal direction is higher then the elongation percentage thereof in the vertical direction. Further, in the rear body cloth 12, the underside of the sleeve is formed as Dolman type so that the polo shirt 10 is loose at the underarm. than the elongation percentage thereof in the vertical direction. Further, in the rear body cloth 12, the line from the underarm to the underside of the sleeve is formed as Dolman type so that the polo shirt 10 is loose at the underarm.

The one-piece front body cloth 11 includes the entire front side of the polo shirt 10 corresponding to the chest and the belly. The right and left edges of the front body cloth 11 are spaced at a predetermined interval from the right and left flank lines L1 and L2, respectively. The stretch direction of the front body cloth 11 indicated with the thick arrow Y is a horizontal (right-to-left) direction. The elongation percentage of the front body cloth 11 in the horizontal direction is higher than the elongation percentage thereof in the vertical direction. As in the case of the rear body cloth 12, in the front body cloth 11, the underside of the sleeve is formed as Dolman type so that the polo shirt 10 is loose at the underarm.

Each of the one-piece flank cloths 13 (13A, 13B) having a width W is formed between the front body cloth 11 and the rear body cloth 12 such that each flank cloth 13 extends along each of the right and left flank line L1 and L2 from the lower end of the front body cloth 11 and that of the rear body cloth 12 to the open lower end of the half-length sleeve 14. Each of the right and left edges of each flank cloth 13 is sewed to each of the flank-side edge of the front body cloth 11 and the flank-side edge of the rear body cloth 12 to form a silhouette of Dolman sleeve so that the polo shirt 10 can easily follow an action of the arms which swing in a wide range.

In the first embodiment, the width W of each flank cloth 13 is set to 8 cm. But the width W thereof may be set to the range from 4 cm to 10 cm.

A sewing line is positioned not along each of the right and left flank lines L1 and L2, but located at a predetermined interval therefrom toward the front body cloth 11 and the rear body cloth 12. The grain direction of the flank cloth 13 indicated with the arrow X is different from that of the front body cloth 11 and that of the rear body cloth 12. That is, the grain direction X of the flank cloth 13 is perpendicular to that of the front body cloth 11 and that of the rear body cloth 12. Because the elongation percentage of the flank cloth 13 in the direction Y is higher than the grain direction X, each of right and left parts 13*a* of the flank cloth 13 along the flank lines L1 and L2 stretches greatly in a longitudinal (vertical) direction, and an under-sleeve part 13*b* stretches greatly in a widthwise (horizontal) direction.

Each of the front-side sleeve cloths 14 (right and left front-side sleeve cloths 14A and 14B) is sewed to the front body cloth 11 along the armhole thereof, the upper edge of the rear-side sleeve part 12*b* of the rear body cloth 12, and the front edge of the under-sleeve part 13*b* of the flank cloth 13, as shown with a reference symbol S of FIGS. 1 through 3. In the front-side sleeve cloth 14, the grain direction indicated with the arrow X is longitudinal. Thus, the elongation direction indicated with the thick arrow Y is horizontal.

As described above, the front side of the sleeve is formed of the front-side sleeve cloth 14; the rear side thereof is formed of the rear-side sleeve part 12*b* integral with the rear body cloth 12; and the underside thereof is formed of the under-sleeve part 13*b* of the flank cloth 13. The horizontal elongation percentage of each of the three sheets of cloth 14, 12*b*, and 13*b* is greater than the vertical elongation percentage thereof. The rear body cloth 12 is not sewed to the rear-side sleeve part 12*b* but integral therewith. Thus, the entire sleeve is stretchable continuously with its rear and flank sides at a high percentage. The front-side sleeve cloth 14 is sewed to the front body cloth 11 along the armhole of the front body cloth 11. When a golfer swings up a golf club, the front part of the golfer's shoulder is in a closed direction. Therefore, it is preferable to stretch the front-side sleeve cloth 14 at a low percentage.

The upper edge of the front body cloth 11 and that of the rear body cloth 12 are sewed to each other along a line located a little forward from the upper end (ridge) of the shoulder to allow the rear body cloth 12 to stretch smoothly horizontally.

Opening 11*a* are formed in upper center part of the front body cloth 11 to open and close the opening 11 with buttons 16. The neck cloth 15 is sewed to the front body cloth 11 and the rear body cloth 12 at the upper edge thereof such that the neck cloth 15 is located around a user's neck. In the embodiment, a rib stitch knitting 17 is sewed to the open lower end of the half-length sleeve to form the half-length sleeve of closed type. But the rib stitch knitting 17 does not have to be necessarily sewed to the open end thereof. In this case, the half-length sleeve is formed as open type. The opening 11*a* may be formed down to the lower end of the front body cloth 11 to form the front body cloth 11 as fully open type, so that the opening is closed with buttons or fasteners.

In the polo shirt 10 having the above-described construction, the flank cloth 13 is formed along each of the flank lines L1 and L2 in the range from the lower end of the front body cloth 11 and that of the rear body cloth 12 to the open lower end of the half-length sleeve 14, with the flank cloth 13 interposed between the front body cloth 11 and the rear body cloth 12. That is, the front body cloth 11 and the rear body cloth 12 are not sewed to each other along the flank lines L1 and L2. Accordingly, the flank cloth 13 has a high elongation percentage along the flank lines L1 and L2, namely, in the longitudinal direction thereof. Thus, as shown in FIG. 3, when a golfer wearing the polo shirt 10 swings the arms upward, the under-sleeve part 13*b* stretches longitudinally to a high extent. Accordingly, the polo shirt 10 does not fit tight when the golfer swings the golf club. That is, the polo shirt 10 can follow the golfer's swinging action preferably.

Further, the rear sleeve part 12*b* is integral with the rear body cloth 12 to allow the region from the back to the sleeve to stretch horizontally to a high extent. Thus, when the golfer twists the body to swing the golf club, the golfer does not feel tight in the region from the back to the sleeve. That is, the polo shirt 10 can follow the golfer's swinging action preferably.

When the golfer swings the golf club downward, the region from the back to the rear-side sleeve part 12*b* of the polo shirt 10 is required to stretch horizontally. At this time, the golfer's shoulder is in a closed direction at the front side of the polo shirt 10. In consideration of this, the front body cloth 11 and the front-side sleeve cloth 14 are sewed to each other along the armhole, as shown with the reference symbol S in FIG. 2 to stretch the upper front side of the polo shirt 10 at a low percentage. Thus, the polo shirt 10 does not become loose in the upper front side thereof. Further, it is preferable that a sewing position is present at the armhole in consideration of design, namely, the external appearance of the polo shirt 10. Further, the region from the underarm to the underside of the sleeve is shaped as Dolman type so that the polo shirt 10 is loose in the region. Therefore, in all of the golfer's actions including the swinging of the arms in a wide range, the polo shirt 10 is not tight at the underarm. Thus, the golfer can swing smoothly.

Figure 4:
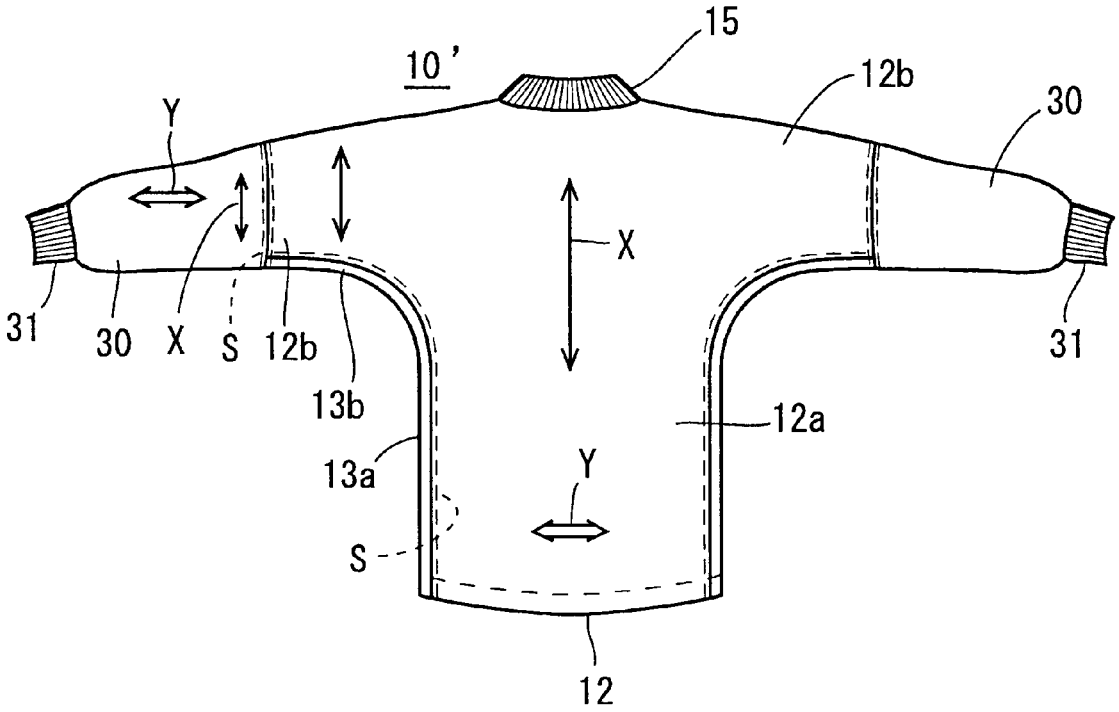
FIG. 4 is a rear view showing a sport outerwear of a second embodiment of the present invention.
Figure 5:
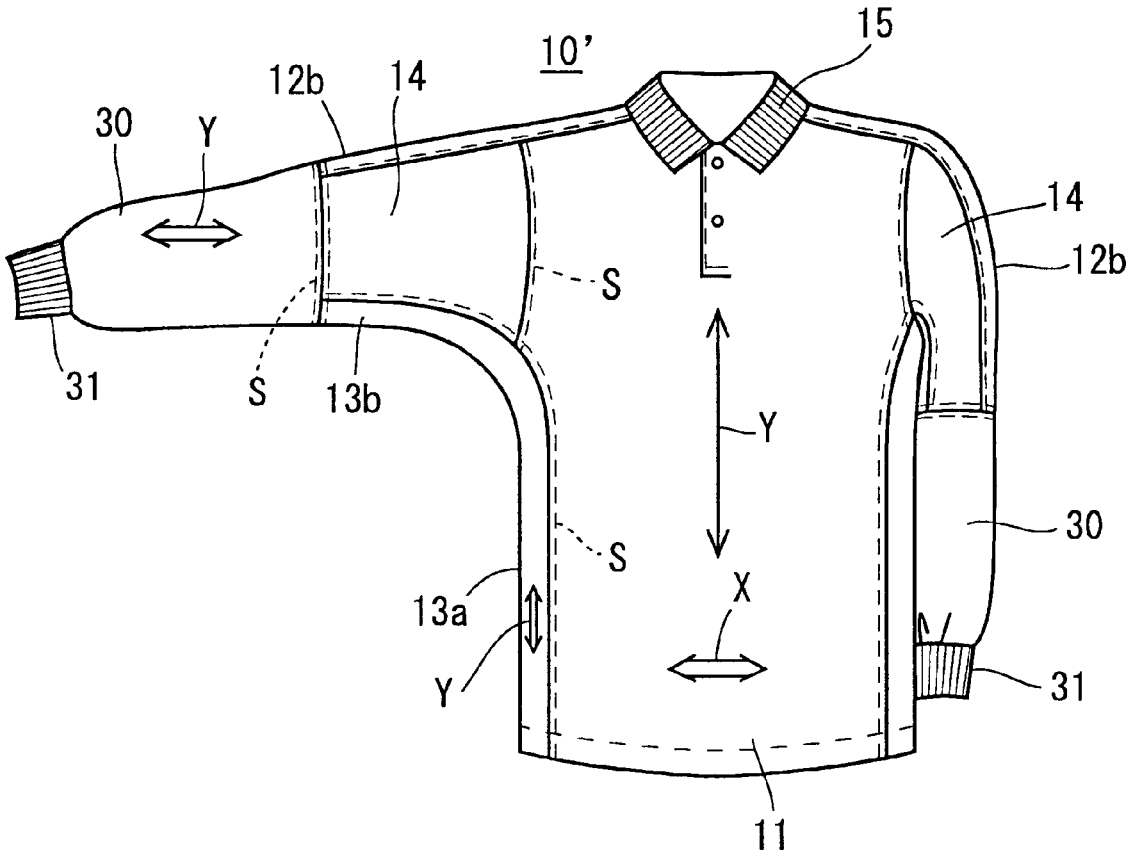
FIG. 5 is a front view showing the sport outerwear shown in FIG. 4.
Figure 6:
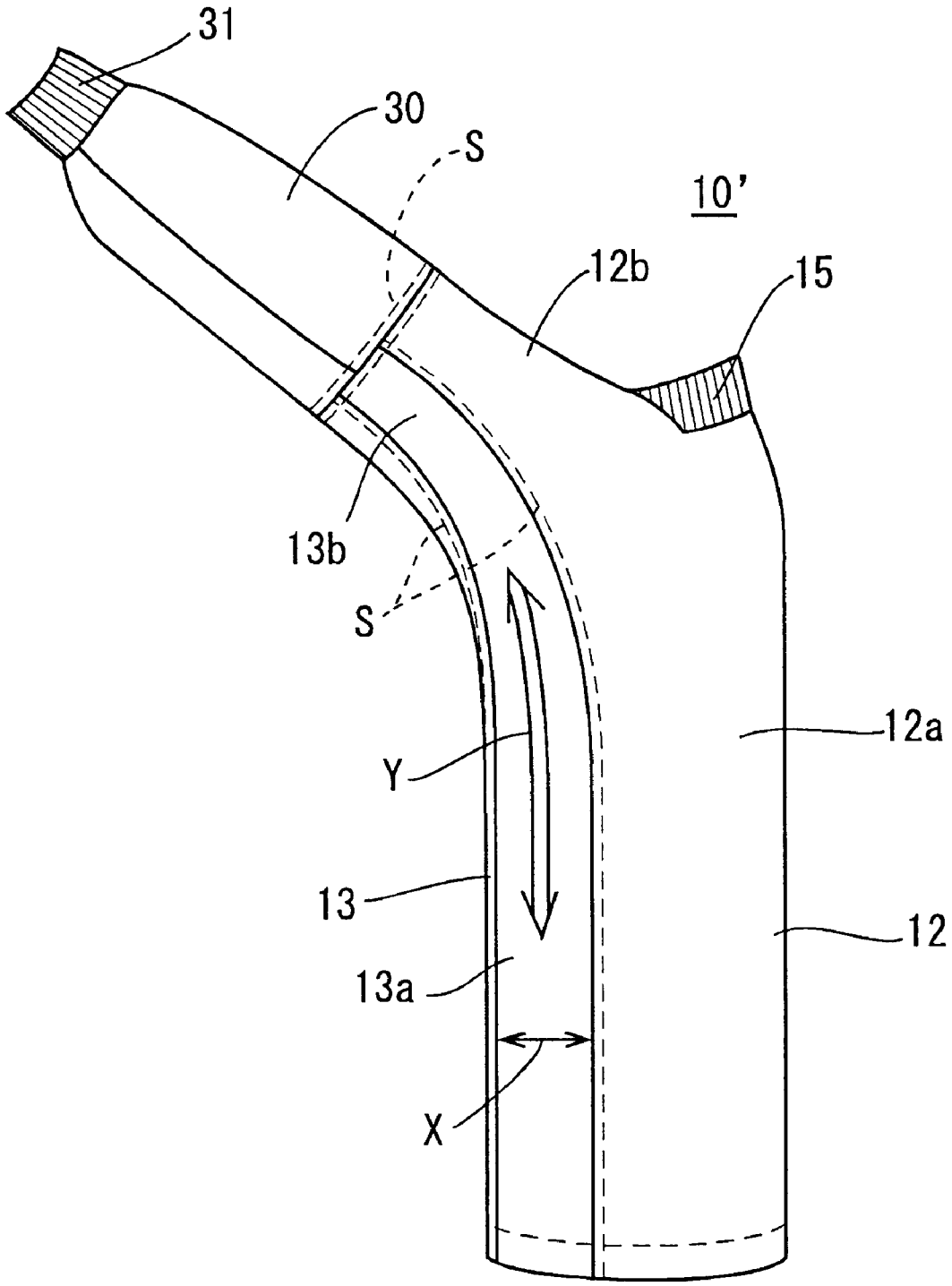
FIG. 6 is a side view showing the sport outerwear of FIG. 4 in the case where a golfer swings the arms upward.

FIGS. 4 through 6 show a polo shirt 10' of a second embodiment. Unlike the polo shirt 10 of the first embodiment, the polo shirt 10' of the second embodiment has a long sleeve. That is, a cylindrical lower side sleeve 30 is added to the half-length sleeve of open type of the first embodiment. That is, the upper end of the cylindrical lower side sleeve 30 is sewed to the lower end of the half-length sleeve above the elbow. The lower end of the lower side sleeve 30 is sewed to a rib stitch knitting 31 to form the lower side sleeve 30 as closed type.

The lower side sleeve 30 is made of the same cloth as the front body cloth 11, the rear body cloth 12, and the flank cloth 13. The grain direction of the lower side sleeve 30 indicated with the arrow X is circumferential. The stretch direction of the cloth of the lower side sleeve 30 indicated with the thick arrow Y perpendicular to the grain direction X is coincident with the lengthwise direction thereof.

Because the other constructions and operations are similar to those of the first embodiment, like parts are designated with like reference numerals and descriptions thereof are omitted herein.

Figure 7:
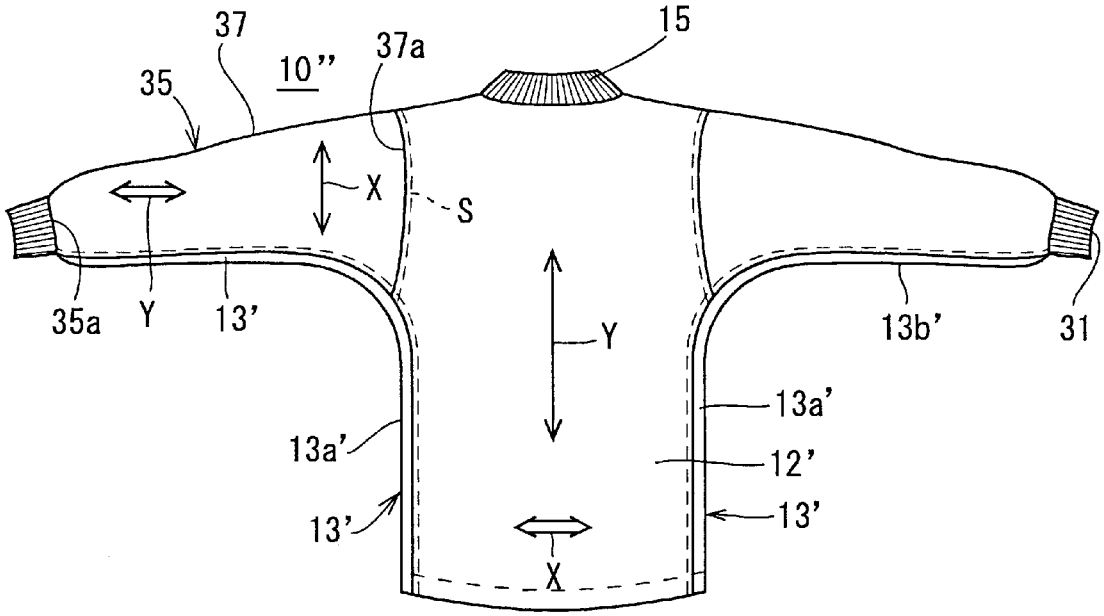
FIG. 7 is a rear view showing a sport outerwear of a third embodiment of the present invention.
Figure 8:
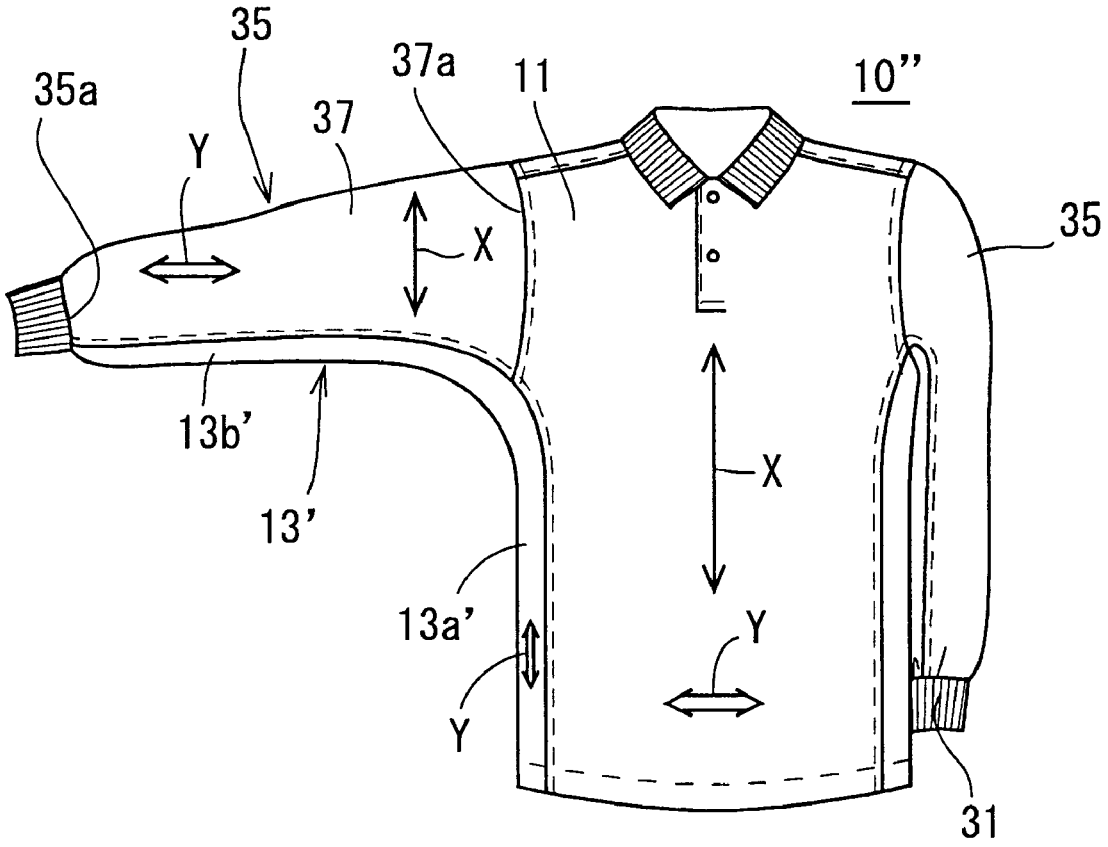
FIG. 8 is a front view showing the sport outerwear shown in FIG. 7.
Figure 9:
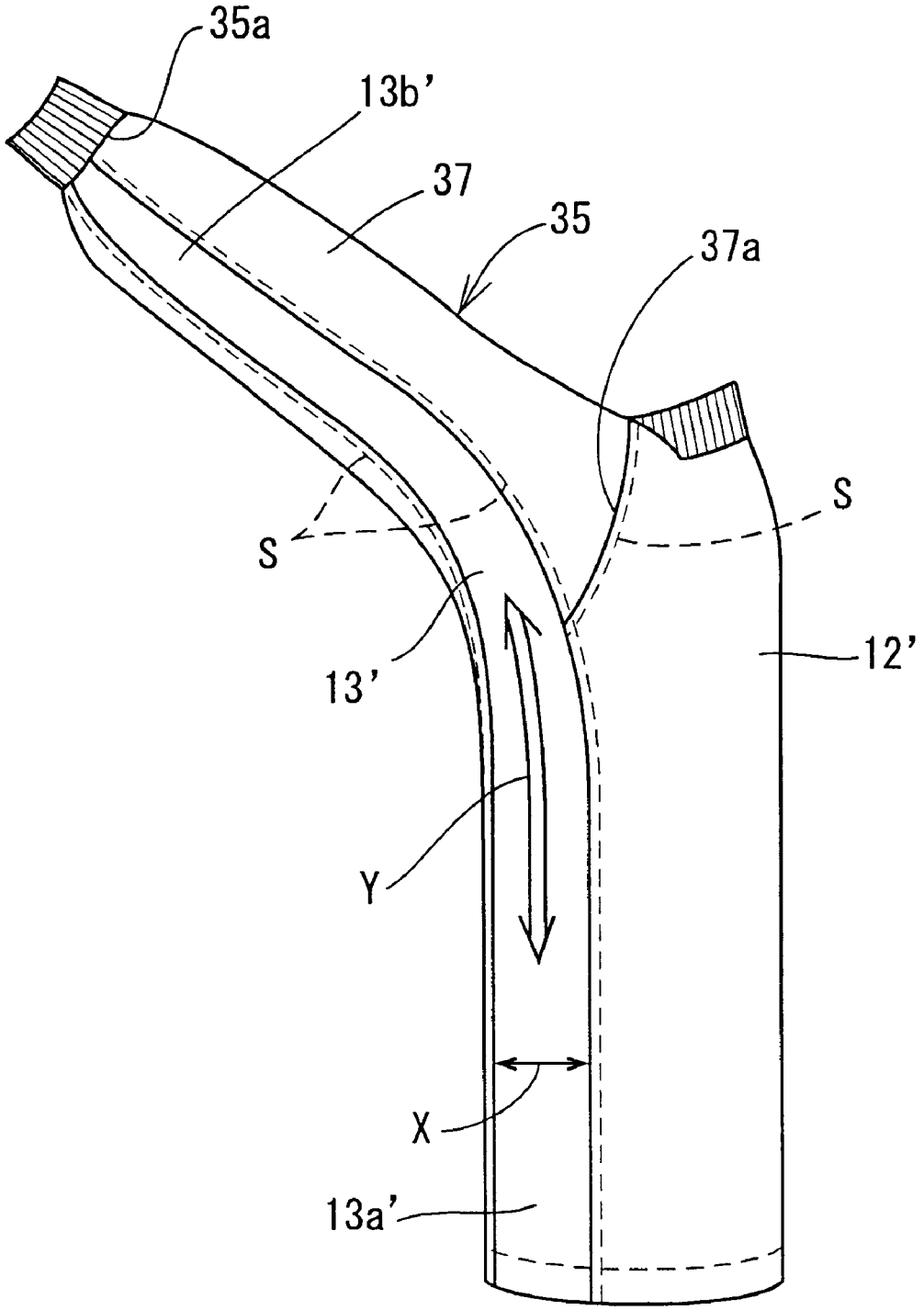
FIG. 9 is a side view showing the sport outerwear of FIG. 7 in the case where a golfer swings the arms upward.

FIGS. 7 through 9 show a polo shirt 10" of a third embodiment. Similarly to the polo shirt 10' of the second embodiment, the polo shirt 10" of the third embodiment has a long sleeve. The polo shirt 10" of the third embodiment is different from the polo shirt 10' of the second embodiment in that each of one-piece right and left flank cloths 13' is formed from the lower end of the front body cloth 11 and that of the rear body cloth 12 to a lower (outer) open end 35*a* of a long sleeve 35. That is, each of the right and left flank cloths 13' is formed as the flank/under-sleeve cloth 13'. The width W of the flank/under-sleeve cloth 13' is set to 8 cm, similarly to the flank cloth 13 of the first embodiment. The direction indicated with the arrow X is the grain direction of the flank/under-sleeve cloth 13'. Thus, the stretch direction of the flank/under-sleeve cloth 13' indicated with the thick arrow Y is longitudinal in a flank part 13*a*' and is the lengthwise direction of the long sleeve in an under-sleeve part 13*b*'. That is, the stretch direction of the under-sleeve part 13*b*' is horizontal when the golfer holds the arms horizontally, vertical when the golfer swings the arms upward, and also vertical when the golfer swings the arms downward.

The third embodiment is similar to the first and second embodiments in that the front body cloth 11 of the third embodiment is not integral with the sleeve, but different therefrom in that the rear body cloth 12' of the third embodiment is not integral with the sleeve. More specifically, an armhole 37*a* of a one-piece sleeve cloth 37 is sewed to the armhole of the front body cloth 11 and that of the rear body cloth 12'.

In the polo shirt 10" of the third embodiment having the long sleeve, along each of the right and left flank lines, the one-piece flank/under-sleeve cloth 13' is formed from the lower end of the front and rear body cloths 11 and 12 to the lower end 35*a* of the long sleeve 35 to allow the flank/under-sleeve cloth 13' to stretch in the longitudinal direction thereof in a great amount. Thus, the polo shirt 10' can easily follow the golfer's swinging action of the arms. In particular, the polo shirt 10" can follow the golfer's swinging action in the region from the underarm to the arm which is made in a wide range.

Figure 10:
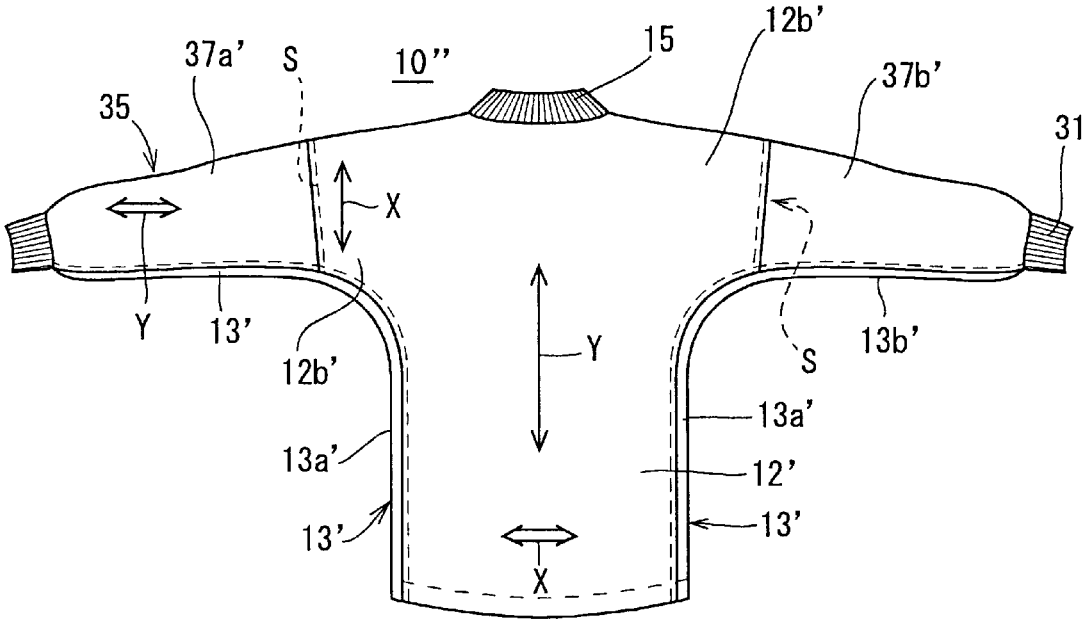
FIG. 10 is a rear view showing an outerwear of a modification of the third embodiment of the present invention.
Figure 11:
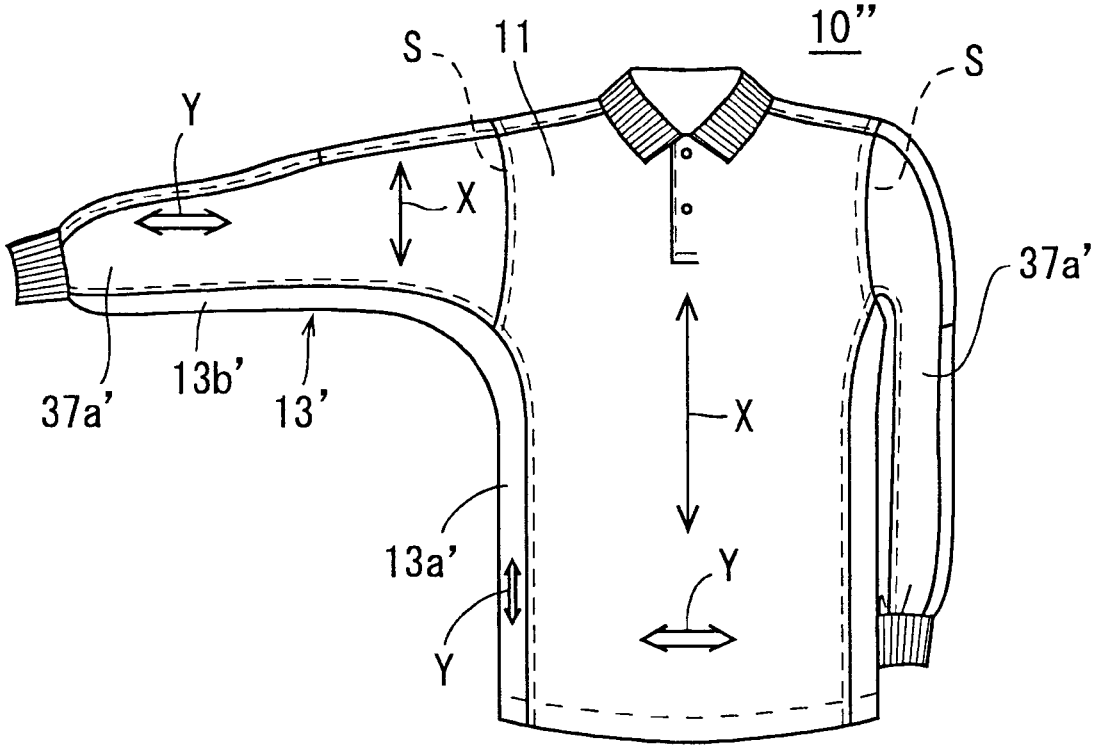
FIG. 11 is a front view showing the outerwear shown in FIG. 10.

As shown in FIGS. 10 and 11 showing a modification, it is possible to integrate a rear-side sleeve cloth 12*b*' extending proximately to the elbow with the rear body cloth 12' and form the sleeve cloth of a front-side sleeve cloth 37*a*' and a rear-side sleeve cloth 37*b*' such that the position at which the rear body cloth 12' and the sleeve cloth are not located at the armhole but located a certain distance toward the edge of the sleeve from the armhole. In this case, the polo shirt 10" is allowed to follow the player's action at the rear body cloth side. The front body cloth and the sleeve cloth are sewed to each other at the armhole to enhance design of the polo shirt 10".

Figure 12A:
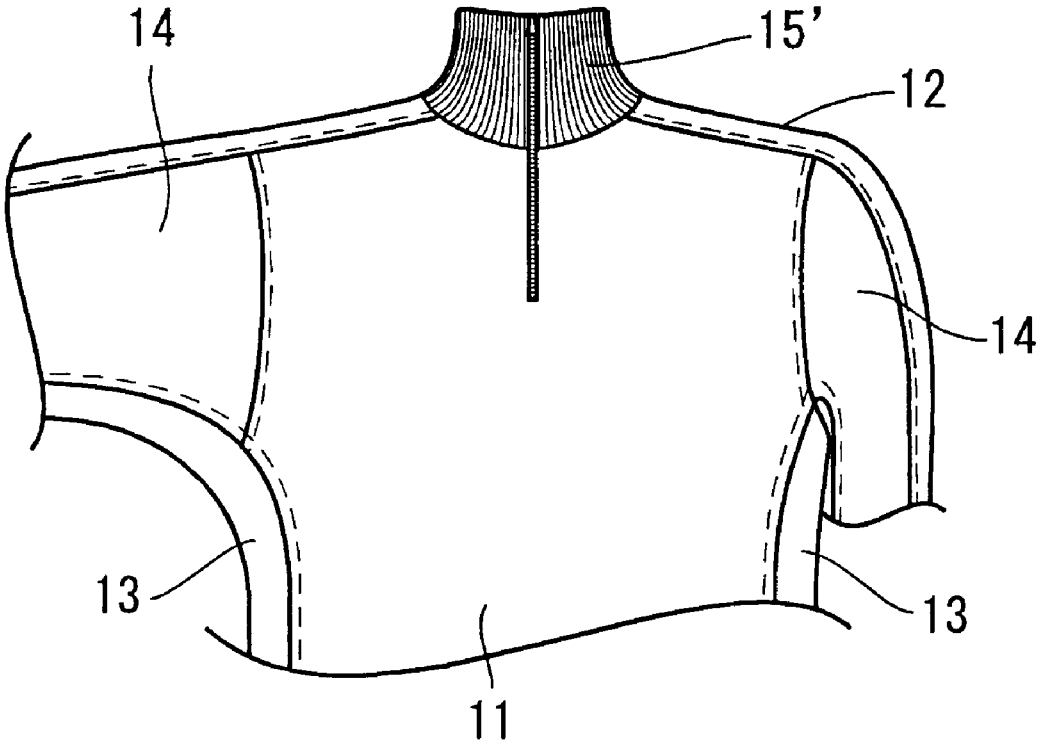
FIGS. 12A, 12B, and 12C are partly front views showing modifications of the outerwear of the present invention.
Figure 12B:
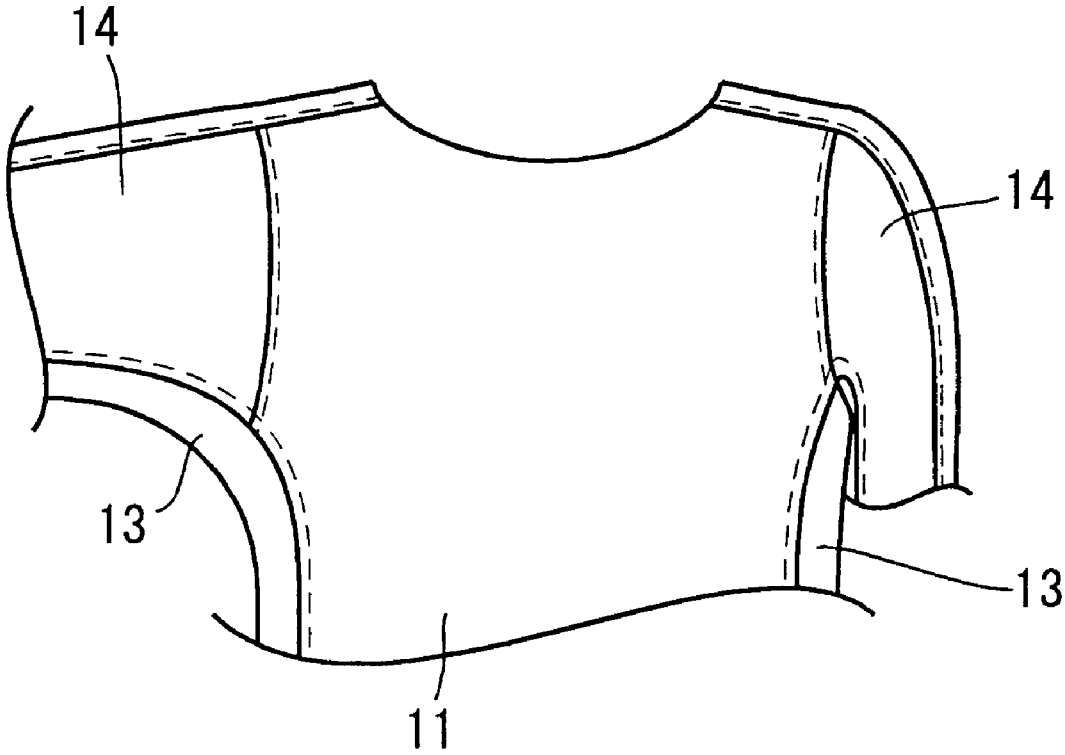
Figure 12C:
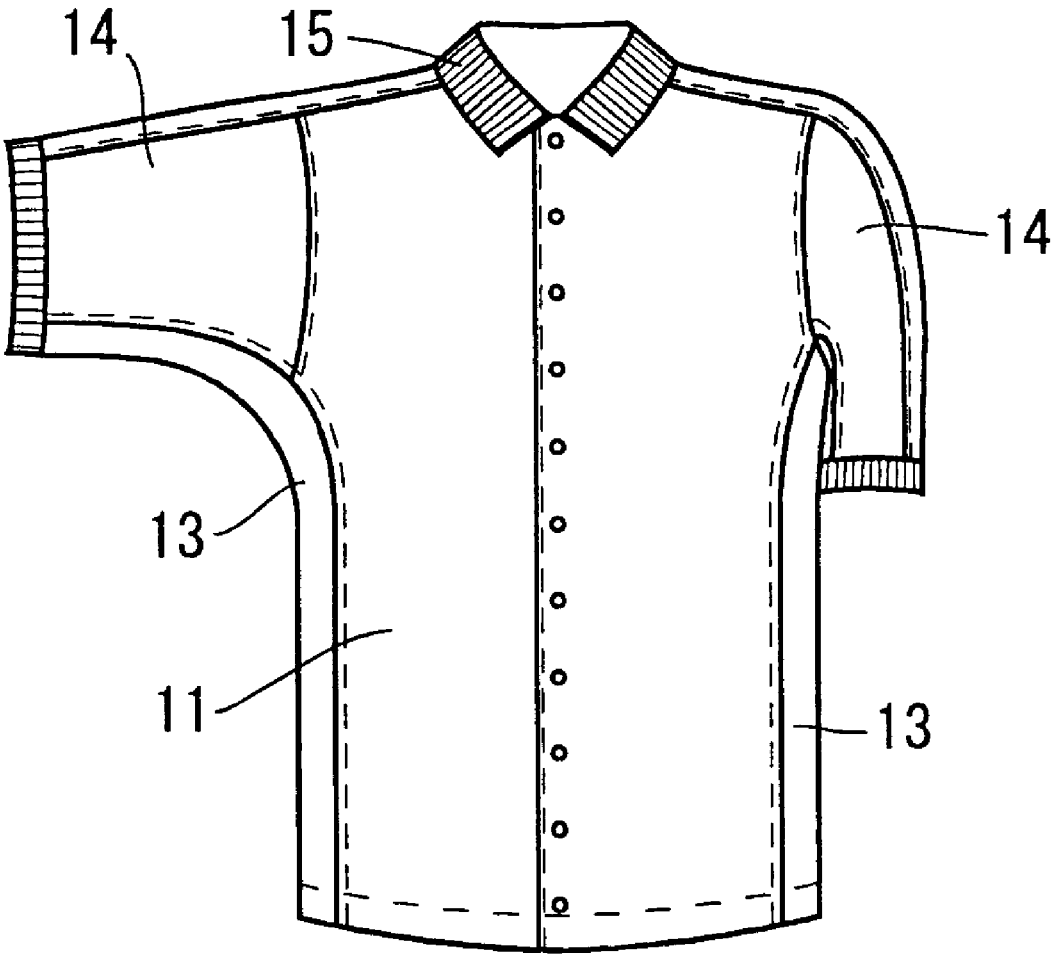

The polo shirt of each of the first through third embodiments has a neck cloth, and the upper front part thereof can be opened and closed. But as shown in FIG. 12A, a neck cloth 15' may be of turtle neck type so that the upper front part of the polo shirt is opened and closed with a fastener. Further, as shown in FIG. 12B, the polo shirt may be of T-shirt type. As shown in FIG. 12C, the polo shirt may be entirely opened in its front part. Each of the polo shirts shown in FIGS. 12A through 12C has the flank cloth 13 extending from the lower end of the front and rear body cloths to the lower (outer) end of the sleeve. Thus, the polo shirts are included in the scope of the sport outerwear of the present invention.

It is possible to use polo shirts of types other than the types shown in FIGS. 12A through 12C as sport shirts for playing ball games such as tennis, badminton, baseball, and the like which necessitate the arms to swing up and down. Further, the outerwear of the present invention may be used preferably as sports shirts for playing ball games such as volley ball, basket ball, soccer ball, and the like which necessitate the arms to swing up and down to a great extent and thus cause it to stretch along its flank line. Not only as sport shirts, the polo shirts are preferably used as outerwear which players can wear comfortably because they are superior in following a swinging motion of arms.

Figure 13:
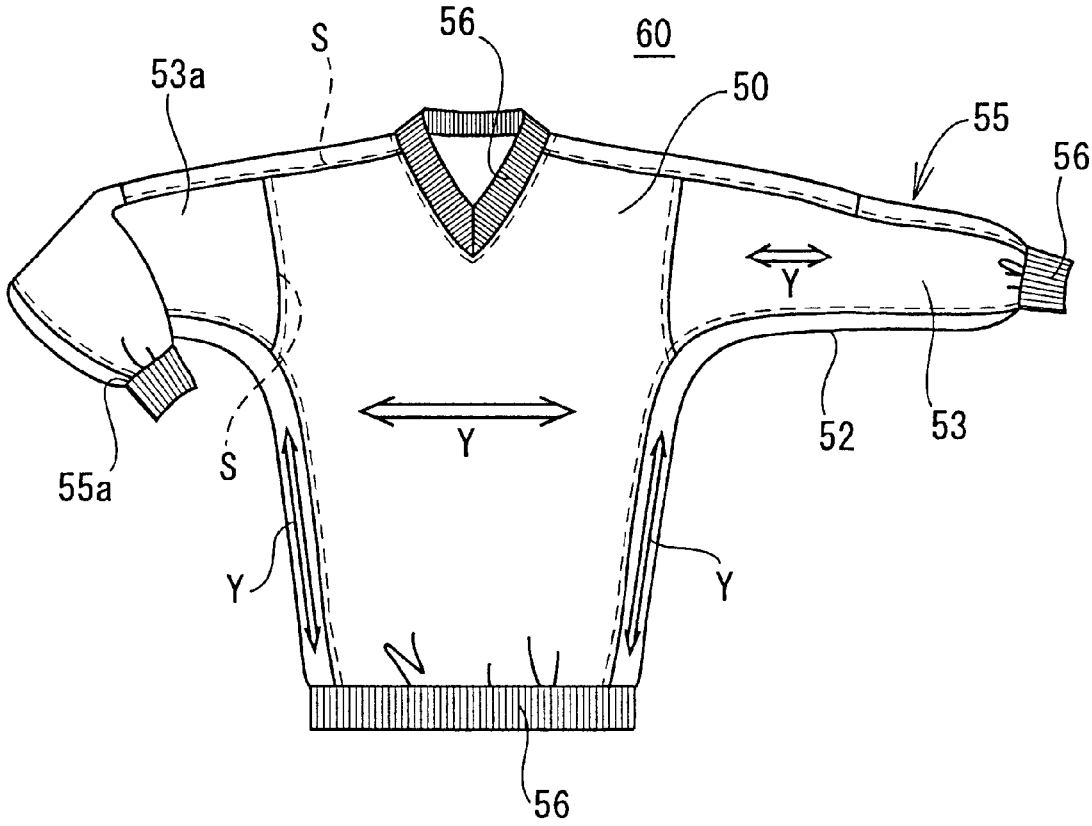
FIG. 13 is a front view showing an outerwear of a fourth embodiment of the present invention.
Figure 14:
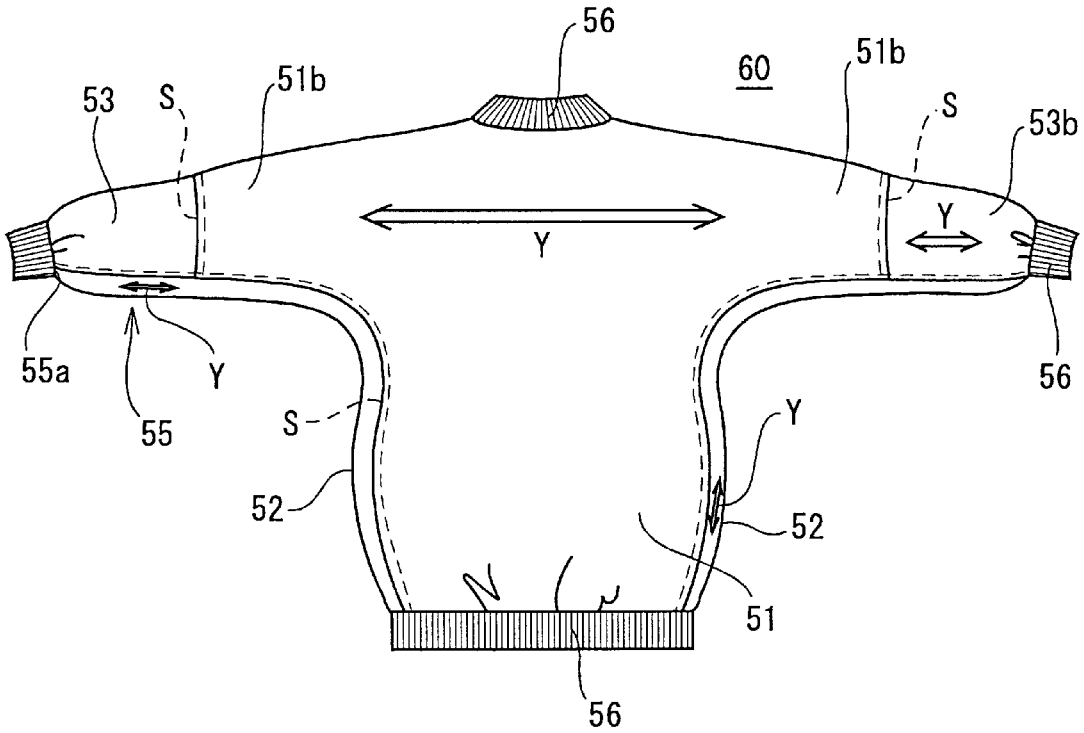
FIG. 14 is a rear view showing the outerwear shown in FIG. 13.
Figure 15A:
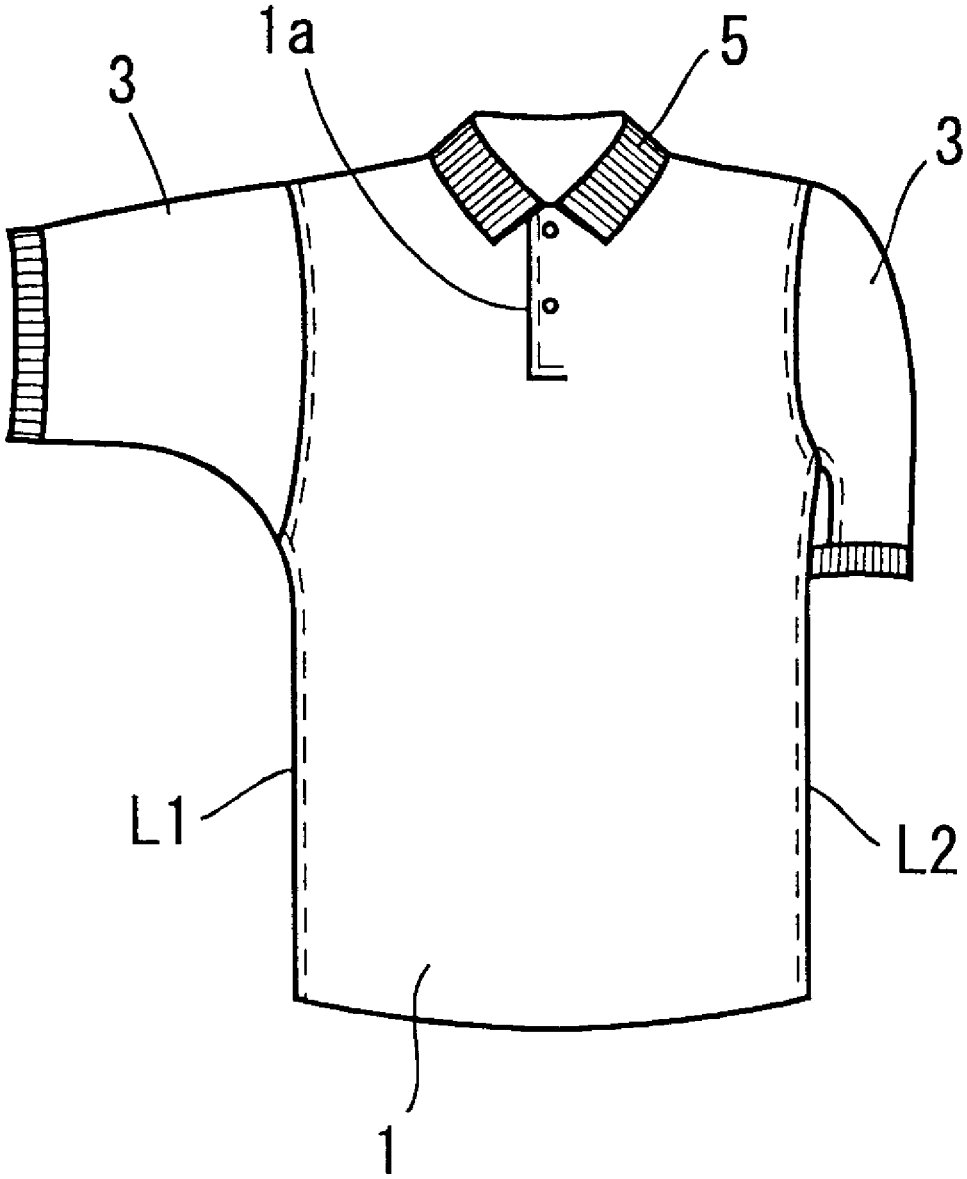
FIG. 15A is a front view showing a conventional polo shirt.
Figure 15B:
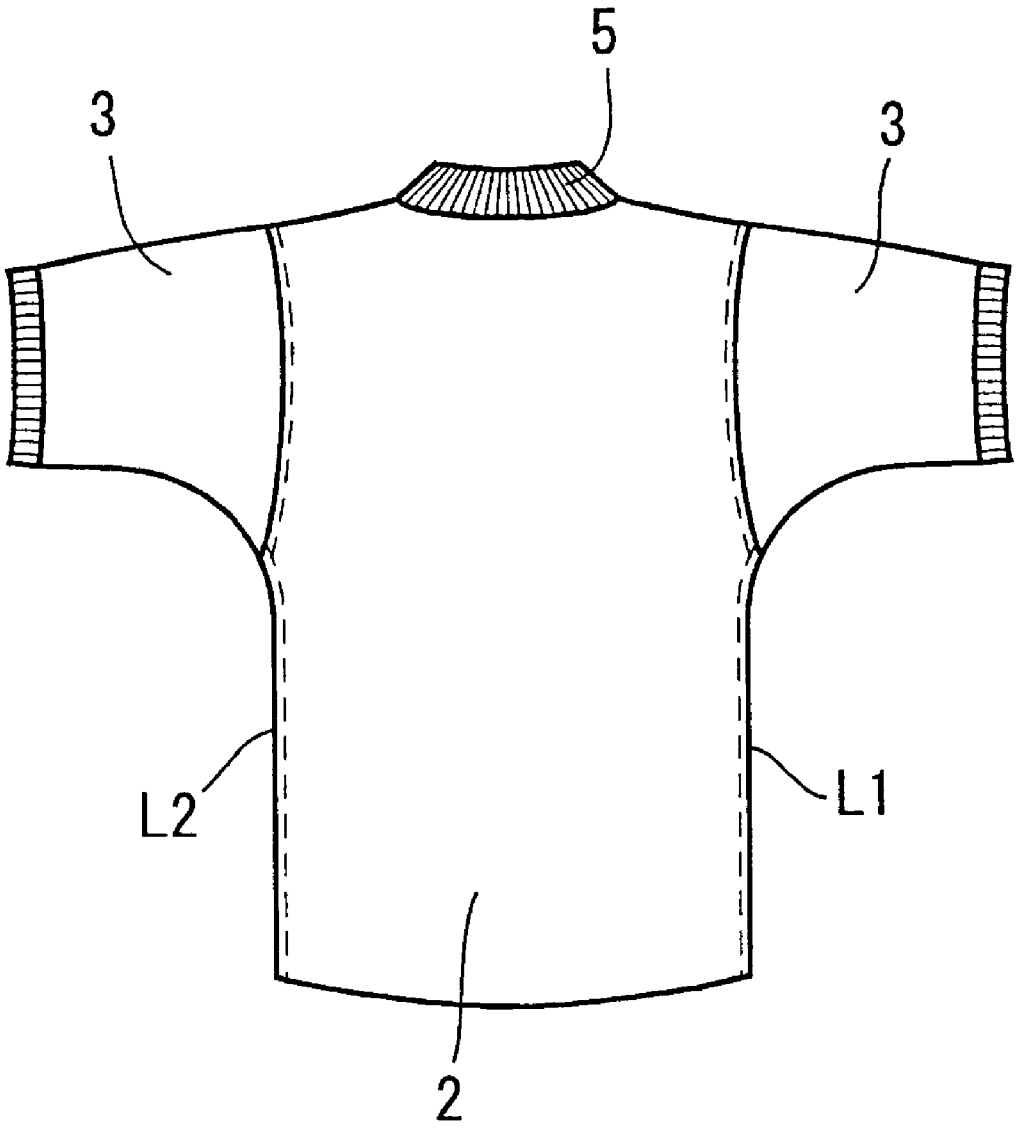
FIG. 15B is a rear view showing the conventional polo shirt of FIG. 15A.

FIGS. 13 and 14 show a windbreaker 60 made of a nonventilative material such as nylon and stretchable in one direction. The windbreaker 60 is constructed of a front body cloth 50, a rear body cloth 51, a flank cloth/under-sleeve cloth 52, and a sleeve cloth 53.

Each of the right and left flank cloths constitutes the flank cloth/under-sleeve cloth 52 formed of one-piece cloth extending from a lower end of each of the front body cloth 50 and the rear body cloth 51 to an open end 55*a* of the long sleeve 55. As indicated with the thick arrow Y, the stretch direction of the flank cloth/under-sleeve cloth 52 is vertical in a flank part 52*a* and is the longitudinal direction of the long sleeve in an under-sleeve part 52*b*. That is, the stretch direction of the under-sleeve part 52*b* is horizontal when the golfer holds the arms horizontally, longitudinal continuously with the flank part 52*a* when the golfer swings the arms upward, and also vertical when the golfer swings the arms downward.

The rear body cloth 51 is integral with a rear-side sleeve part 51*b* extending proximately to the elbow. The front body cloth 50 does not have an opening/closing part but the neck thereof is V-shaped to allow a user to put on the windbreaker by slipping it over the user's head. The front body cloth 50 is sewed to the sleeve cloth 53 at the armhole. The stretch direction of the front body cloth 50 and that of the rear body cloth 51 are horizontal, as shown with the thick arrow Y. The shape of the neck of the windbreaker is not limited to V but may be U-shaped or in other shapes. The windbreaker may have an opening part on the front body cloth 50, instead of formation of the neck.

The sleeve cloth 53 is constructed of a front-side sleeve cloth 53*a* and a rear-side sleeve cloth 53*b*. The rear-side sleeve cloth 53*b* and the rear-side sleeve part 51*b* of the rear body cloth 51 are sewed to each other in the vicinity of the elbow, as shown with a sewing line S in FIG. 14. At the side of front body cloth 50, the front-side sleeve cloth 53*a* and the front body cloth 50 are sewed to each other at the armhole, as shown with a sewing line S in FIG. 14. The stretch direction of the sleeve cloth 53 is horizontal (longitudinal direction of sleeve) as shown with the thick arrow Y.

A rib stitch portion 56 is installed on each of the V neck, the lower end of the front and rear body cloths, and the edge of the sleeve to prevent wind from entering the opening parts.

In the windbreaker formed of the nonventilative material, the flank line stretches at a high percentage, and the rear body cloth stretches at the armhole. Therefore, when a tennis player or a golfer wears the windbreaker on a windy day or a cold day, they can play tennis or golf comfortably because the windbreaker can follow players' swinging actions of their arms.

Similarly to the above-described embodiments, a flank cloth/under-sleeve cloth made of a waterproof material and stretchable longitudinally from the flank line to the under-sleeve may be sewed to the front and rear body cloths to make a rainwear. The rainwear does not prevent a tennis player and a golfer from smoothly swinging their arms on a rainy day. They can wear the rainwear comfortably not as a sport outerwear but as a rainwear because it can follow their actions.

As apparent from the foregoing description, the outerwear of the present invention provides the following effects: the front body cloth is sewed to one edge of each of the right and left flank cloths, and the rear body cloth is sewed to the other edge of each of the right and left flank cloths. Thus, unlike the conventional outerwear, each of the sewing lines is not coincident with each of the flank lines. Thus, the flank cloth can stretch at a high percentage along the flank line. Further, the elongation percentage of each of the right and left flank cloths is set high in the longitudinal direction thereof. Let it be supposed that the outerwear of the present invention is used as an outerwear of sports such as golf wear or a tennis wear. When a golfer swings up a golf club in a wide range or a tennis player swings up a racket in a wide range, the flank line stretches longitudinally in a great amount. Accordingly, the outerwear does not fit tight in the flank region. That is, the outerwear can preferably follow their swinging actions and the like, thus facilitating and enhancing their actions.

In case that the rear body cloth is formed of one-piece cloth such that the rear body cloth covers a rear part of a sleeve, the stretch of the sport outerwear in the region from the back to the arm thereof is not prevented when the golfer or the tennis player twists the body. This is because no sewing line is not present between the rear body cloth and the sleeve. Thus, the sport outerwear can preferably follow the players' swinging actions and the like.

In case that the right and left flank cloths are of Dolman type, it is loose at the underarm, such that the golfer or the tennis player does not feel tight and can swing the arms smoothly and widely. Further, a beautiful silhouette can be formed along the flank line. Moreover, because outerwear of Dolman type can be worn comfortably, it can be used not only as a sport outerwear, but also as a multi-purpose outerwear.

In the case where the outerwear of the present invention is used as a windbreaker made of a nonventilative material and as a rainwear made of a waterproof material, the windbreaker and the rainwear can preferably follow arm's swinging actions. Thus, the windbreaker and the rainwear do not prevent players' actions.

What is claimed is:

1. An item of outerwear comprising a front body cloth, a rear body cloth, right and left flank cloths having a predetermined width, and right and left sleeve cloths, each said flank cloth having two lengthwise edges, one lengthwise edge of each right and left flank cloth is sewed to said front body cloth and a remaining lengthwise edge of each right and left flank cloth is sewed to said rear body cloth such that each sewing line does not coincide with right and left flank lines, each said right and left flank cloth is of a length to form an under-sleeve part, which continues to the arm opening of the sleeve, and said under-sleeve part is sewed to said sleeve cloth;

an elongation percentage of said front body cloth and said rear body cloth, and each said sleeve cloth is higher in a horizontal direction thereof than in a vertical direction thereof, and an elongation percentage of each said flank cloth is higher in a vertical direction thereof than in a horizontal direction thereof, said direction being in relation to said item of outerwear being worn by a wearer in a standing position.

2. The item of outerwear according to claim 1, wherein said rear body cloth is formed of one-piece of cloth such that said rear body cloth continues outwardly in two directions to form a rear part of each sleeve.

3. The item of outerwear according to claim 1, wherein said under-sleeve forming part of said flank cloth is formed so as to result in Dolman type sleeves.

4. The item of outerwear according to claim 2, wherein said under-sleeve forming part of said flank cloth is formed so as to result in Dolman type sleeves.

5. An item of outerwear according to any one of claims 1 through 3, wherein said outerwear is formed as a windbreaker made of a nonventilative material or formed as a rainwear made of a waterproof material.

* * * * *